US010477307B1

(12) United States Patent
Zhang et al.

(10) Patent No.: US 10,477,307 B1
(45) Date of Patent: Nov. 12, 2019

(54) WATERPROOF HEADPHONE STRUCTURE

(71) Applicant: Harman International Industries, Incorporated, Stamford, CT (US)

(72) Inventors: Isword Zhang, Stamford, CT (US); Cary Zou, Stamford, CT (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/240,341

(22) Filed: Jan. 4, 2019

(51) Int. Cl.
*H04R 1/44* (2006.01)
*H04R 1/10* (2006.01)

(52) U.S. Cl.
CPC ..... *H04R 1/44* (2013.01); *H04R 1/1016* (2013.01); *H04R 1/1058* (2013.01); *H04R 1/1091* (2013.01)

(58) Field of Classification Search
CPC ..... H04R 1/44; H04R 1/1016; H04R 1/1058; H04R 1/1091
USPC ..... 381/380
See application file for complete search history.

(56) References Cited

U.S. PATENT DOCUMENTS 5,677,964 A * 10/1997 Sun ..... H04R 1/105 381/189
9,866,940 B2 1/2018 Walker et al.
2012/0217087 A1* 8/2012 Ambrose ..... H04R 1/1016 181/130
2013/0259286 A1* 10/2013 Chung ..... H04R 1/1016 381/380
2014/0064548 A1* 3/2014 Chu ..... H04R 1/1091 381/380
2014/0348346 A1* 11/2014 Fukuda ..... H04R 1/1016 381/151
2015/0289051 A1* 10/2015 Tung ..... H04R 1/44 381/334
2017/0048608 A1* 2/2017 Yang ..... H04R 1/1083

FOREIGN PATENT DOCUMENTS

CN 207691991 U 8/2018
CN 207820175 U 9/2018

* cited by examiner

*Primary Examiner* — Sean H Nguyen
(74) *Attorney, Agent, or Firm* — Brooks Kushman P.C.

(57) ABSTRACT

In at least one embodiment, a waterproof headphone assembly is provided. The assembly includes an earphone. The earphone includes a neck portion, a base portion, and a flexible skirt. The neck portion defines an attachment channel that extends about a first axis. The base portion defines an audio channel along with the neck portion. The audio channel extends along a second axis that is perpendicular to the first axis and enables a transmission of an audio signal from a transducer to a user. The flexible skirt is removably coupled to at least one outer recess of the attachment channel positioned on the neck portion. The attachment channel enables water collected from within the audio channel to be removed therefrom when the flexible skirt is removed from the at least one outer recess.

20 Claims, 5 Drawing Sheets

WATERPROOF HEADPHONE STRUCTURE

TECHNICAL FIELD

Aspects disclosed herein generally relate to a waterproof headphone structure to play back audio for a user.

BACKGROUND

CN207820175U ("the '175 utility model") discloses high sealing waterproof headphones. The waterproof headphones include an earphone housing comprising a body, and a housing provided inside the earphone headset assembly body. The earphone housing side sound hole has a main body, and the front-end face of the earphone housing body is provided with an auxiliary sound hole. The sound hole of the main and the auxiliary sound holes are provided externally with a metal filter and the bottom surface of the earphone housing body is provided with a collar. The front-end face of the intermediate body is provided with an earphone housing rotating wheel. The rotating wheel is symmetrically disposed outside the two connection blades with an outer blade mounting connector seal ring that includes a gap. The present invention when not in use, can be effectively sealed by the rotation of the entire structure of the two sound holes, to ensure the sealing ability of the headset is not in use, increase the water resistance.

SUMMARY

In at least one embodiment, a waterproof headphone assembly is provided. The assembly includes an earphone. The earphone includes a neck portion, a base portion, and a flexible skirt. The neck portion defines an attachment channel that extends about a first axis. The base portion defines an audio channel along with the neck portion. The audio channel extends along a second axis that is perpendicular to the first axis and enables a transmission of an audio signal from a transducer to a user. The flexible skirt is removably coupled to at least one outer recess of the attachment channel positioned on the neck portion. The attachment channel enables water collected from within the audio channel to be removed therefrom when the flexible skirt is removed from the at least one outer recess.

In at least another embodiment, a waterproof headphone assembly is provided. The assembly includes an earphone. The earphone includes a transducer, a neck portion, a base portion, and a flexible skirt. The transducer provides an audio signal. The neck portion defines an attachment channel that extends about a first axis. The base portion defines an audio channel along with the neck portion. The audio channel extends along a second axis that is perpendicular to the first axis and enables a transmission of the audio signal to a user. The flexible skirt is removably coupled to at least one outer recess of the attachment channel positioned on the neck portion. The attachment channel enables water collected from within the audio channel to be removed therefrom when the flexible skirt is removed from the at least one outer recess.

In at least another embodiment, a waterproof headphone assembly is provided. The assembly includes an earphone. The earphone includes a transducer, a neck portion, a base portion, and a flexible skirt. The transducer provides an audio signal. The neck portion defines an attachment channel that extends about a first axis. The base portion defines an audio channel along with the neck portion to enable transmission of an audio signal from the transducer positioned within the base portion to a user. The audio channel extends along a second axis that is perpendicular to the first axis and enables transmission of the audio signal to a user. The flexible skirt is removably coupled to at least one outer recess of the attachment channel positioned on the neck portion. The attachment channel enables water collected from within the audio channel to be removed therefrom when the flexible skirt is removed from the at least one outer recess.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Waterproof earphones (or headphones) may utilize different kinds of water proof mesh or acoustic paper to prevent water from entering into ear housing. Alternatively, waterproof earphones may utilize a high thickness component or coating to protect an acoustic transducer (or loudspeaker) within the earphone to achieve the same objective. However, the water proof mesh and/or larger thickness of the coating on the loudspeaker may cause attenuation of sound quality at both a low frequency range and a high frequency range. The earphone structure as disclosed herein may mitigate such an attenuation of sound quality at both frequency ranges and provide improved acoustic performance similar to earphones that are not required to meet a waterproof requirement. For example, the waterproof earphone as disclosed herein utilizes a thinner coating which increases frequency response and improves acoustic performance at the low and high frequency ranges.

The disclosed earphone structure also includes at least one outer recess and an attachment channel that enables liquid to pass therethrough after the earphone is immersed with water. For example, the leakage hole serves as a bypass for a user to drain water from within an audio channel that is defined by a main body section of the earphone in the event the audio channel is filled with water as it is not completely possible to prevent water intrusion into the earphones. An ear cap (or flexible skirt is provided) and includes a mating end to interface with the outer recesses. The flexible skirt is removable from the body of the earphone. Thus, the outer recesses serve to couple the flexible skirt to the body of the ear phone and also serves to enable water to pass from within the audio channel of the body when the flexible skirt is removed from the body. A metal mesh is provided within the body to prevent an in-rush of water from damaging a diaphragm of a loudspeaker positioned within the earphone. These aspects and others will be discussed in more detail below.

Figure 1:
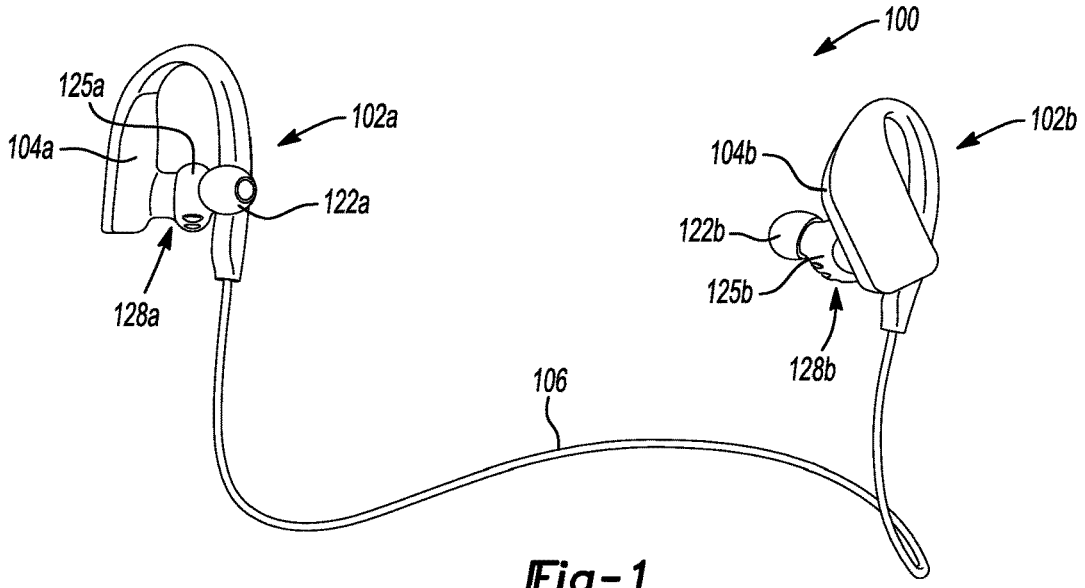
FIG. 1 depicts a view of a waterproof headphone assembly in accordance to one embodiment.

FIG. 1 depicts a view of a waterproof headphone assembly (or headphones) 100 in accordance to one embodiment. The assembly generally includes earphones 102*a*-102*b* (or "102"). The earphones 102*a*, 102*b* generally includes a corresponding housing 104*a*, 104*b*, respectively. A mobile device (not shown) or other media playback device (not shown) may transmit audio data to the headphones 100 to playback audio data for the user. The earphones 102*a* and 102*b* includes transducers 128*a*, 128*b*, respectively, to playback audio data for the user. In another example, the headphones 100 may include memory (not shown) positioned in at least one of the housings 104 to store the audio data and to playback the same for the user as opposed to the mobile device providing the audio data for the headphones 100. It is recognized that the headphones 100 may not be used exclusively for audio playback. For example, the headphones 100 may also include a microphone (not shown) to receive an audio input from the user. The headphones 100 may in turn transmit the audio input to a mobile device or other suitable device in the event the headphones 100 are used in connection with the mobile device for mobile communication with another party.

A flexible coated wire 106 is attached to each end of the housings 104*a*, 104*b*. The coated wire 106 generally includes electrical wiring to facilitate electrical communication between the electronics (not shown) positioned within each housing 104*a* and 104B. The earphones 102*a*, 102*b* generally includes a flexible skirt 122*a*, 122*b* (or "122"), respectively, and an enhancer 125*a*, 125*b* ("125"). The flexible skirt 122 is generally inserted into an ear canal of a user to provide the audio data. The enhancer 125 is generally positioned within a concha of a user' ear to provide comfort for the user when the earphone 102 is inserted into the ear of the user.

Figure 2:
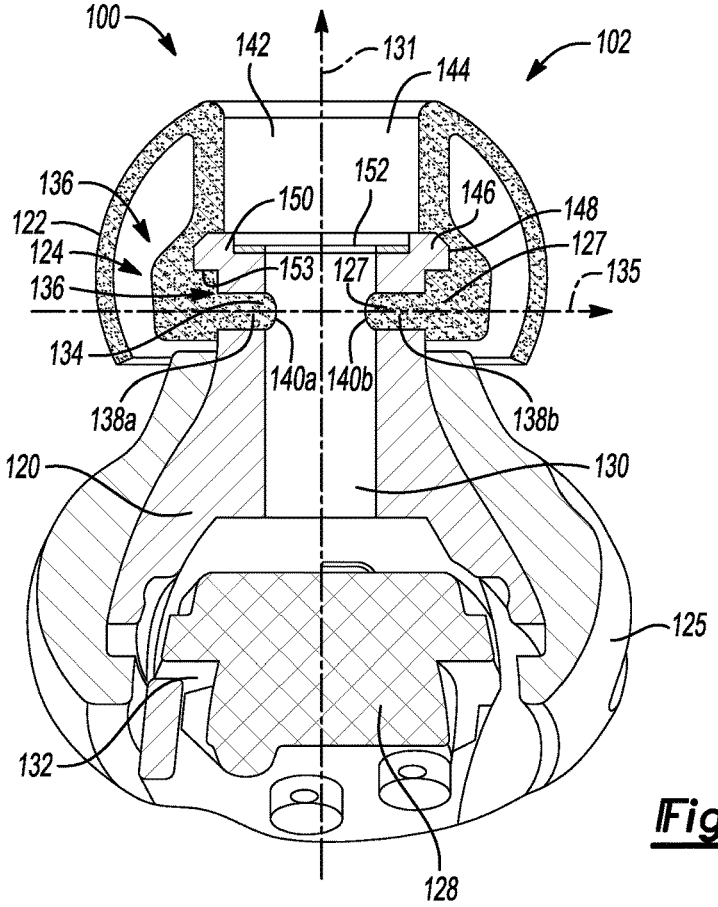
FIG. 2 depicts one cross-sectional view of an earphone in accordance to one embodiment.

FIG. 2 depicts one cross-sectional view of an earphone 102 of the assembly 100 in accordance to one embodiment. The earphone 102 generally includes a main body section 120 and the flexible skirt 122. The main body section 120 is generally formed of plastic. The enhancer 125 may be removably coupled to the main body 120 to provide comfort for the user. The flexible skirt 122 is removably coupled to the main body section 120. The main body section 120 includes neck portion 124 and a base portion 126. A loudspeaker (or transducer) 128 is generally positioned within the base portion 126 of the earphone 102. In general, a user inserts the earphone 102 into a corresponding ear thereof via the flexible skirt 122 and the transducer 128 transmits audio signals into the ear of the user. The main body section 120 defines an audio channel 130 to enable the audio signals to be transmitted from the transducer 128, through the flexible skirt 122 and into the ear of the user. The audio channel 130 extends about a center axis 131 of the earphone 102.

The base portion 126 is generally wider than the neck portion 124 and defines a transducer chamber 132 to receive the transducer 128. The neck portion 124 defines an attachment channel 134 that enables fluid to drain from the audio channel 130 when the flexible skirt 122 is not attached to the neck portion 124. The attachment channel 134 extends about a first axis 135. The first axis 135 is generally perpendicular to the center axis 131. The flexible skirt 122 and the neck portion 124 form an interface 136 to attach the flexible skirt 122 to the main body section 120. For example, the interface 136 may include attachment tabs 138*a* and 138*b* and corresponding recesses 140*a* and 140*b*. In the example illustrated in FIG. 2, the attachment tabs 138*a* and 138*b* are integrated with the flexible skirt 122 for insertion into the recesses 140*a* and 140*b* that are formed by outer portions of the attachment channel 134. The flexible skirt 122 is generally formed of silicon. Thus, the attachment tabs 138*a* and 138*b* may be inserted into the recesses 140*a* and 140*b*, respectively, and deform during the insertion to form an interference fit thereof.

The flexible skirt 122 includes an inner wall 142 that defines an audio opening 144. The audio opening 144 is positioned in a center portion of the flexible skirt 122 and the audio opening 144 is axially aligned with the center axis 131. The neck portion 124 includes an outer flange 146. The flexible skirt 122 includes a radial opening 148 that receives the outer flange 146 to also fix or attach the flexible skirt 122 to the neck portion 124 (i.e., to the main body section 120). As noted above, the flexible skirt 122 is generally formed of silicon. Thus, the flexible skirt 122 can be flexed and positioned over the neck portion 124 to attach the flexible skirt 122 to the main body section 120. In this case, a portion 127 of the flexible skirt 122 may slide or be pulled over the outer flange 146. After which, the recesses 140*a* and 140*b* of the neck portion 124 receive the attachment tabs 138*a* and 138*b*, respectively, to couple the flexible skirt 122 to the main body section 120. Likewise, the flexible skirt 122 may be positioned over the outer flange 146 to fix the flexible skirt 122 to the main body section 120. The outer flange 124 includes a ledge portion 150 that is positioned lower within the audio opening 144 than a top portion of the outer flange 146. An underside 153 of the ledge portion 150 prevents the portion 127 of the flexible skirt 122 from sliding back over the outer flange 146 and serves to further couple the flexible skirt 122 to the main body section 120. The user can remove the flexible skirt 122 from the main body section 120 as required or needed (e.g., any number of times) without affecting the ability to reattach the flexible skirt 122 to the main body section 120.

A metal mesh 152 is fixedly attached to the ledge portion 150. In one example, the metal mesh 152 may be fixed to the ledge portion 150 via adhesive. The metal mesh 152 is arranged to enable audio from the transducer 128 to pass to the ear of the user. In addition, the metal mesh 152 serves to mitigate or dampen the effect of an in-rush or torrent of fluid (e.g., water) from damaging the transducer 128. Specifically, the metal mesh 152 may reduce the pressure rate associated with a significant flow of fluid into the audio channel 130. In addition, the metal mesh 152 may prevent water intrusion into the audio channel 130.

It is recognized that a coating may be applied to the transducer 128 to enhance the waterproof characteristics of the earphones 102. Whether a coating is required for the transducer 128 depends on the type of material used to construct the diaphragm of the transducer 128. This aspect will be discussed in more detail below. The attachment channel 134 and the outer recesses 140*a*, 140*b* thereof enable fluids to be drained from within the main body section 120 of the earphone 102. For example, while the metal mesh 152 may generally prevent water from entering into the main body section 120, it is recognized that in some cases, the earphone 102 may be exposed to a significant amount of water in the event the earphone 102 falls out of the user's ear, etc. In this case, water may still pass through the metal mesh 152 and reside within the audio channel 130. In addition, water may penetrate through the metal mesh 152 after numerous uses within the water. The user may remove the flexible skirt 122 from the main body section 120 and drain the water from the main body section 120 from the attachment channel 134 and the outer recesses 140*a*, 140*b* thereof. Conventional earphones may not provide this aspect and thus water may collect over time and continue to reside within the earphones. For example, it may be difficult to drain the water back through the metal mesh once water is collected and retained within the earphones as the metal mesh itself serves to block water on its way out of the earphones. The use of the attachment channel 134 and the outer recesses 140*a*, 140*b* enable water to be removed (or drained) from the earphone 102.

Provided that the earphone 102 can drain water via the attachment channel 134 and the outer recesses 140*a*, 140*b* when the flexible skirt 122 is removed, the overall thickness of the metal mesh 152 and thickness of the coating over the transducer 128 may be reduced (e.g., if a coating is required to protect the diaphragm of the transducer). This aspect also yields an improvement with sound performance. In this case, a thickness of the metal mesh 152 may be between 0.15 mm to 0.3 mm. If the diaphragm of the transducer 128 is constructed from PET, then a coating is not necessary for application to the transducer 128 and the transducer 128 may pass the IPX7 test for headphones. The overall thickness of the diaphragm is 6 μm and the thickness may vary from 5 to 8 μm based on performance tuning. If the diaphragm of the transducer 128 is constructed of another type of material such as an organic material, then a NANO coating may be applied to the transducer and the thickness of the coating and the diaphragm may be 100-800 nm. By reducing the thickness of the metal mesh 152, this condition provides an improved frequency response for the earphone 102 compared to prior art implementations. For example, the earphone 102 is capable of providing improved performance over various frequencies and may improve the overall frequency response by 6 to 7 KHz.

Figure 3:
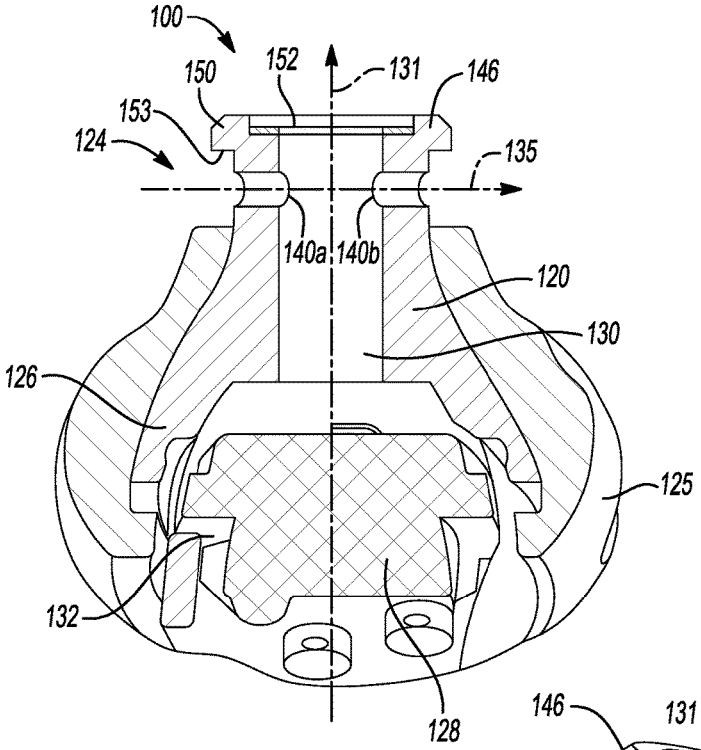
FIG. 3 depicts another cross-sectional view of the earphone in accordance to another embodiment.

FIG. 3 depicts another cross-sectional view of the earphone 102 in accordance to another embodiment. Specifically, the earphone 102 of FIG. 3 provides the main body section 120 without being attached to the flexible skirt 122.

Figure 4A:
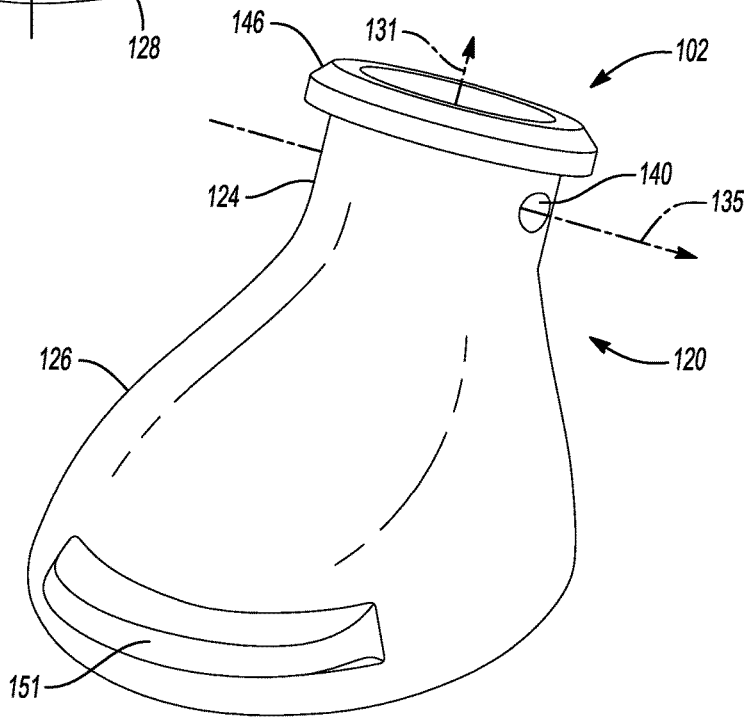
FIG. 4A depicts an external view of a body of the earphone in accordance to one embodiment.

FIG. 4A depicts an exterior view of the main body 120 of the earphone 102 in accordance to one embodiment. A tab 151 is formed on an outer side of the main body section 120. The tab 151 interfaces with the enhancer 125 to couple the enhancer 125 to the main body section 120. This aspect will be described in more detail in connection with FIG. 5.

Figure 4B:
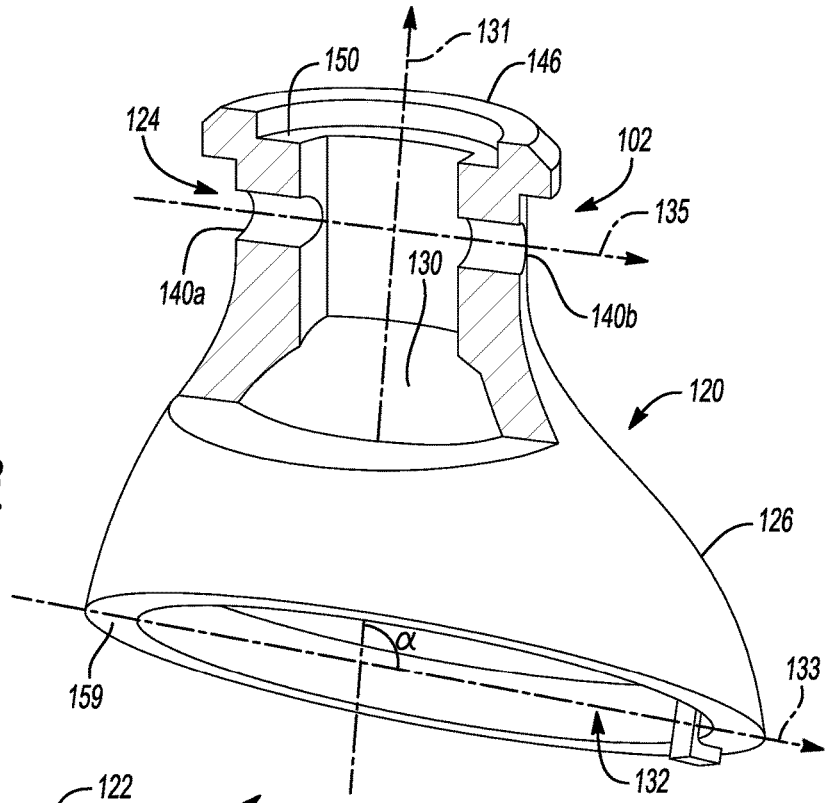
FIG. 4B depicts a partial cross-sectional view of a neck portion of the headphone structure in accordance to one embodiment.

FIG. 4B depicts a partial cross-sectional view of a neck portion 124 of the earphone 102 in accordance to one embodiment. As shown in FIG. 4B, the center axis 131 may form an angle other than 90 degrees with respect to a bottom section 159 of the base portion 126. For example, a second axis 133 is positioned at the bottom section of the base portion 126 to illustrate that the center axis 131 is formed at an angle α other than 90 degrees with respect to the bottom section 159 of the base portion 126. The angle α is generally greater than 90 degrees. FIG. 4B also illustrates the transducer chamber 132 that receives the transducer 128.

Figure 5:
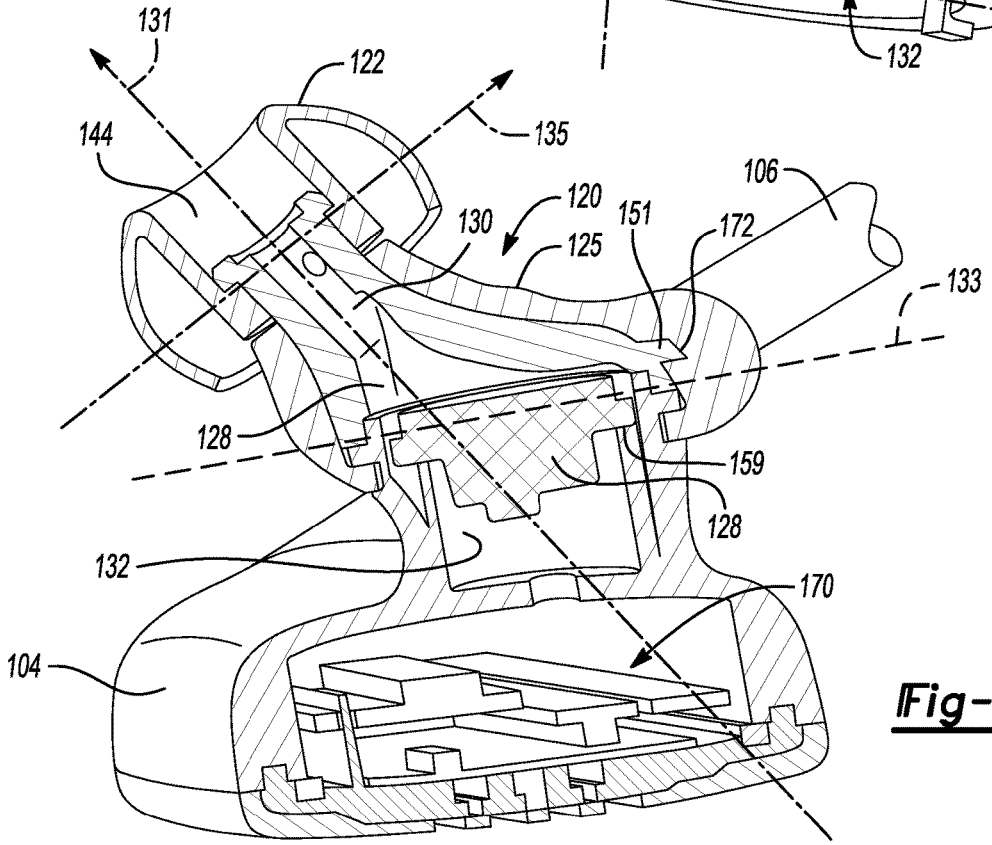
FIG. 5 depicts a cross-sectional view of the earphone 102 and the headphone housing 104 in accordance to one embodiment.

FIG. 5 depicts a cross-sectional view of the earphone 102 and the headphone housing 104 in accordance to one embodiment. Headphone electronics 170 are positioned within the housing 104 to drive the transducer 128 to provide the audio data and to communicate with the mobile device or other playback device. As shown, the enhancer 125 includes an opening 172 to receive the tab 151 to secure the enhancer 125 to the main body section 120.

Figure 6A:
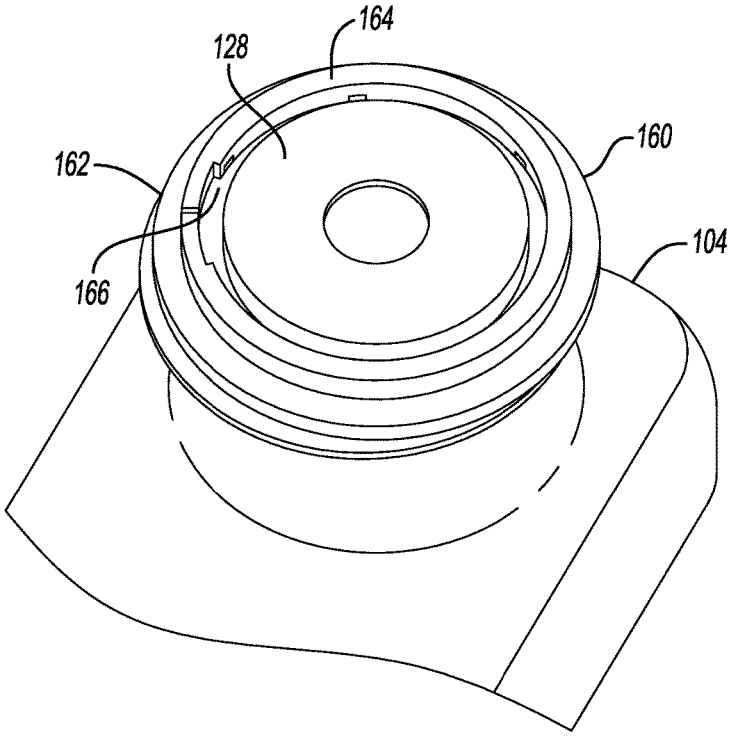
FIG. 6A depicts a first view of a headphone housing in accordance to one embodiment.
Figure 6B:
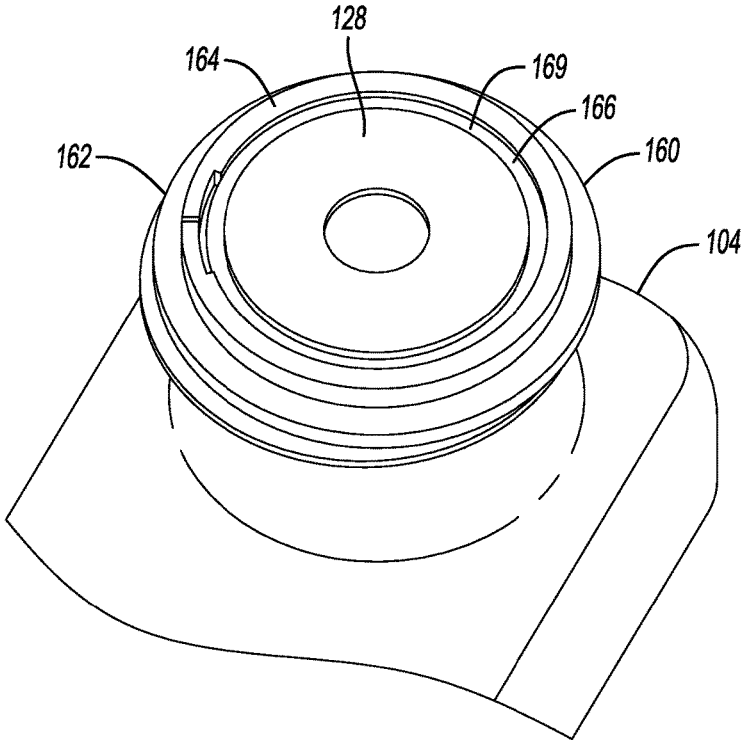
FIG. 6B depicts a second view of a headphone housing in accordance to one embodiment.

FIG. 6A illustrates one embodiment of a headphone housing 104 that includes a transducer support section 160. The transducer support section 160 may be integrated with the headphone housing 104. The transducer support section 160 is configured to receive and support the transducer 128. For example, the transducer support section 160 generally includes an outer lip 162. The bottom section 159 of the base portion 126 may be inserted over the outer lip 162 to attach the earphone 102 to the headphone housing 104. The transducer support section 160 also includes an outer ring 164 that surrounds the transducer 128. An outer edge of the transducer 128 and the outer ring 164 define a transducer channel 166. FIG. 6B illustrates that adhesive 169 may be applied into the transducer channel 166 to fix the transducer 128 to the headphone housing 104.

Figure 7:
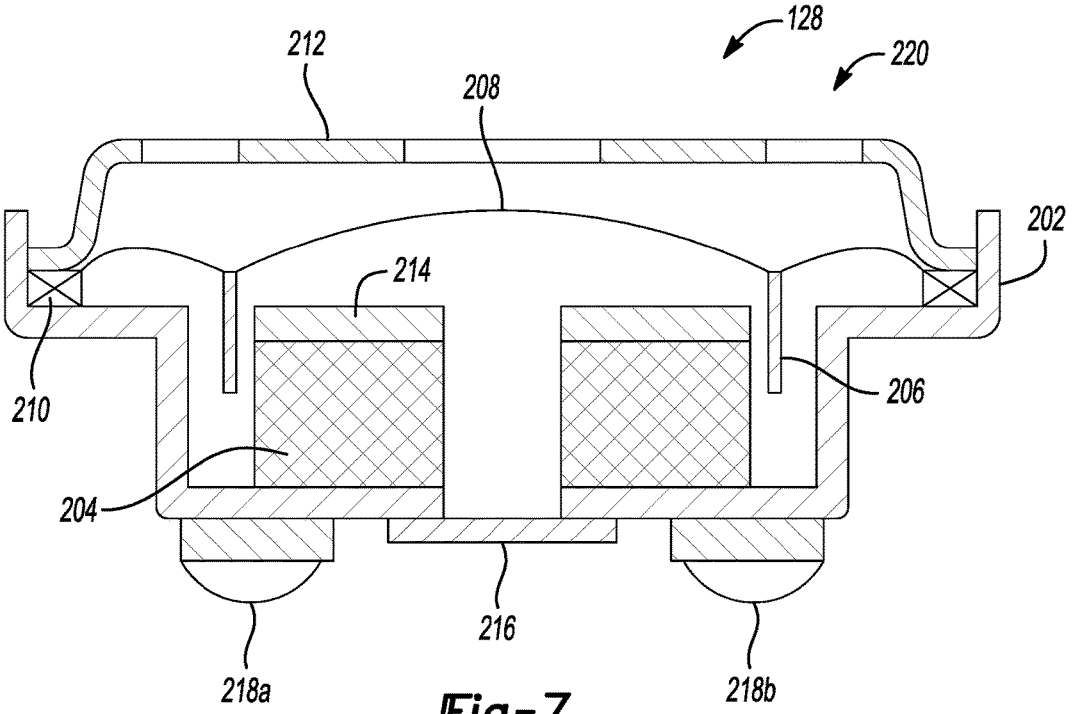
FIG. 7 depicts a cross-sectional view of the transducer of the earphone in accordance to another embodiment.

FIG. 7 depicts a more detailed view of the transducer 128 in accordance to one embodiment. The transducer 128 generally includes a metal housing 202 that supports a magnet 204. The metal housing 202 and the magnet 204 define an air gap for receiving a voice coil 206. A flexible diaphragm 208 is coupled to the voice coil 206. An end of the diaphragm 208 (or a surround) is coupled to a holding ring 210. The holding ring 210 is a non-metal ring (e.g., plastic) that supports the diaphragm 208. A voice coil wire may pass through the holding ring 210 and the diaphragm 208. A metal cover 212 (or frame) is positioned over the voice coil 206 and the diaphragm 208. The metal cover 212 is attached to the metal housing 202 and the holding ring 210 to prevent water intrusion. The metal cover 212 generally supports the transducer 128. In one example, the metal cover 212 may be stainless steel. A washer 214 is positioned on top of the magnet 204. The washer 214 may be a pole piece and may be constructed of iron and/or steel. The washer 214 coacts with the magnet 204 to provide a uniform and steady magnetic field. A mesh 216 (or acoustic paper) is positioned and attached to a bottom section of the metal housing 202. The mesh 216 may be used to tune the final transducer acoustic response curve. A pair of wire terminals 218*a*, 218*b* are electrically coupled to the transducer 128 to provide a voltage to the transducer 128 that corresponds to an audio input. In general, the voltage in the magnet 204 causes the voice coil 206 to move linearly upward and downward based on a magnetic field that is generated by the magnet 204 in the air gap. As the voice coil 206 moves, the flexible diaphragm 208 moves to generate an audio signal that is represented by frequencies that comprise the audio input. As noted above, the transducer 128 itself may have at least one coating layer 220 applied thereover to insulate the transducer 128 from water intrusion in the event the diaphragm 208 is not formed of a PET material (or waterproof material). In general, the thickness of the transducer 138 is from 5-8 μm and the thickness of the coating 220 (e.g., a NANO coating), if applied to the transducer 138, may be 100-800 nm depending on the type of waterproof test that is employed. The coating layer 120 may also be applied over any exposed terminals 218*a*, 218*b*. The coating layer 120 may comprise a Nano coating. As noted above, given that less coating is required due to the attachment channel 134 and the outer recesses 140*a*, 140*b* of the attachment channel 134, it may not be necessary to apply a thicker layer of the coating over the transducer 128. This aspect improves the frequency response of the earphone 102. Likewise, the overall thickness of the metal mesh 152 may be reduced. Reducing the overall thickness of the metal mesh 152 also enables the earphone 102 to achieve improved frequency response performance and thereby enhance the listening experience for the user.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A waterproof headphone assembly comprising:
an earphone including:
a neck portion that defines an attachment channel that extends about a first axis;
a base portion that defines an audio channel along with the neck portion, the audio channel extending along a second axis that is perpendicular to the first axis and enabling a transmission of an audio signal from a transducer to a user; and
a flexible skirt being removably coupled to at least one outer recess of the attachment channel positioned on the neck portion, wherein the attachment channel enables water collected from within the audio channel to be removed therefrom when the flexible skirt is removed from the at least one outer recess.

2. The headphone assembly of claim 1, wherein the flexible skirt defines an audio opening that extends at a third axis that is axially aligned with the second axis for transmitting the audio signal into an ear of a user.

3. The headphone assembly of claim 2 further comprising a metal mesh positioned in the neck portion and below the audio opening to prevent water intrusion into the audio channel.

4. The headphone assembly of claim 3, wherein the metal mesh is positioned above the attachment channel.

5. The headphone assembly of claim 3, wherein a thickness of the metal mesh is within a range of 0.15 mm to 0.3 mm.

6. The headphone assembly of claim 3, wherein the neck portion includes an outer flange to receive the flexible skirt.

7. The headphone assembly of claim 6, wherein the outer flange includes a ledge portion that is positioned lower in relation to a top portion of the outer flange to receive the metal mesh.

8. A waterproof headphone assembly comprising:
an earphone including:
a transducer to provide an audio signal;
a neck portion that defines an attachment channel that extends about a first axis;
a base portion that defines an audio channel along with the neck portion, the audio channel extending along a second axis that is perpendicular to the first axis and enabling transmission of the audio signal to a user; and
a flexible skirt being removably coupled to at least one outer recess of the attachment channel positioned on the neck portion, wherein the attachment channel enables water collected from within the audio channel to be removed therefrom when the flexible skirt is removed from the at least one outer recess.

9. The headphone assembly of claim 8, wherein the flexible skirt defines an audio opening that extends at a third axis that is axially aligned with the second axis for transmitting the audio signal into an ear of the user.

10. The headphone assembly of claim 9 further comprising a metal mesh positioned in the neck portion and below the audio opening to prevent water intrusion into the audio channel.

11. The headphone assembly of claim 10, wherein the metal mesh is positioned above the attachment channel.

12. The headphone assembly of claim 10, wherein a thickness of the metal mesh is within a range of 0.15 mm to 0.3 mm.

13. The headphone assembly of claim 10, wherein the neck portion includes an outer flange to receive the flexible skirt.

14. The headphone assembly of claim 13, wherein the outer flange includes a ledge portion that is positioned lower in relation to a top portion of the outer flange to receive the metal mesh.

15. The headphone assembly of claim 8, wherein the transducer is positioned within the base portion.

16. A waterproof headphone assembly comprising:
an earphone including:
a transducer to provide an audio signal;
a neck portion that defines an attachment channel that extends about a first axis;
a base portion that defines an audio channel along with the neck portion to enable transmission of an audio signal from a transducer positioned within the base portion to a user, the audio channel extending along a second axis that is perpendicular to the first axis and enabling transmission of the audio signal to a user; and
a flexible skirt being removably coupled to at least one outer recess of the attachment channel positioned on the neck portion, wherein the attachment channel enables water collected from within the audio channel to be removed therefrom when the flexible skirt is removed from the at least one outer recess.

17. The headphone assembly of claim 16, wherein the flexible skirt defines an audio opening that extends at a third axis that is axially aligned with the second axis for transmitting the audio signal into an ear of the user.

18. The headphone assembly of claim 17 further comprising a metal mesh positioned in the neck portion and below the audio opening to prevent water intrusion into the audio channel.

19. The headphone assembly of claim 18, wherein the metal mesh is positioned above the attachment channel.

20. The headphone assembly of claim 19, wherein a thickness of the metal mesh is within a range of 0.15 mm to 0.3 mm.

* * * * *